US006969180B2

(12) United States Patent
Waters

(10) Patent No.: US 6,969,180 B2
(45) Date of Patent: Nov. 29, 2005

(54) LED LIGHT APPARATUS AND METHODOLOGY

(76) Inventor: Ryan Waters, 16505 La Cantera Pkwy. #123, San Antonio, TX (US) 78256

( * ) Notice: Subject to any disclaimer, the term of this patent is extended or adjusted under 35 U.S.C. 154(b) by 66 days.

(21) Appl. No.: 10/374,949

(22) Filed: Feb. 25, 2003

(65) Prior Publication Data

US 2004/0165379 A1 Aug. 26, 2004

(51) Int. Cl.[7] ..... F21V 9/00
(52) U.S. Cl. ..... 362/293; 362/373; 362/800
(58) Field of Search ..... 362/231, 240, 362/293, 294, 373, 800

(56) References Cited

U.S. PATENT DOCUMENTS 4,419,716 A * 12/1983 Koo ..... 362/96
4,488,207 A * 12/1984 Harmon ..... 362/231
4,519,021 A 5/1985 Oram
4,838,697 A * 6/1989 Kurandt ..... 362/294
D304,694 S 11/1989 Goss
5,324,962 A 6/1994 Komoto et al.
5,655,832 A 8/1997 Pelka et al.
D385,051 S 10/1997 Wu
D388,726 S 1/1998 Wu
5,752,766 A 5/1998 Bailey et al.
5,921,652 A 7/1999 Parker et al.
D422,100 S 3/2000 Zhang et al.
6,139,166 A 10/2000 Marshall et al.
6,149,283 A 11/2000 Conway et al.
6,273,589 B1 * 8/2001 Weber et al. ..... 362/293
6,369,525 B1 4/2002 Chang et al.
6,379,022 B1 4/2002 Amerson et al.
6,402,347 B1 * 6/2002 Maas et al. ..... 362/294
6,411,046 B1 6/2002 Muthu
6,443,594 B1 9/2002 Marshall et al.
6,445,139 B1 9/2002 Marshall et al.
6,715,901 B2 * 4/2004 Huang ..... 362/294
2002/0135997 A1 9/2002 Lammers
2002/0191394 A1 12/2002 Coleman et al.
2003/0147144 A1 8/2003 Roddy et al.

* cited by examiner

*Primary Examiner*—Y. My Quach-Lee
(74) *Attorney, Agent, or Firm*—Michelle Evans; Gunn & Lee, P.C.

(57) ABSTRACT

An LED light apparatus and methodology that can produce a collinear beam of white or colored light. The apparatus has a housing which incorporates three sets of LED light assemblies each set having a plurality of LED lights arranged in an a x a, a x b or other suitable geometric pattern. Each set contains LED lights of the same color, being either red, blue or green. A dichroic bandpass filter and a dichroic notch filter are also incorporated. The apparatus is attached to a power driver which connects to a microcontroller, being a DMX controller, TC/IP controller, or the like. When the apparatus is turned on, red light from the red LED lights passes through the dichroic bandpass filter. The resulting light then combines with the blue light from the blue LED lights and passes through dichroic notch filter. This next light stream then combines with the green light from the green LED lights to form a collinear beam of white or colored light.

16 Claims, 7 Drawing Sheets

LED LIGHT APPARATUS AND METHODOLOGY

BACKGROUND OF THE INVENTION

1. Field of the Invention

Applicant's invention relates to an LED light apparatus and methodology. More particularly the present invention relates to an LED light apparatus and methodology that can produce a collinear beam of white or colored light.

2. Background Information

An LED is a light emitting diode. A diode is a semiconductor i.e. a material with a varying ability to conduct electrical current. A semiconductor with extra electrons is referred to as N-type material and in this material free electrons move from a negatively charged area to a positively charged area. In contrast, a semiconductor with extra holes is a P-type material. Electrons in the P-type material jump from hole to hole moving from a negatively charged area to a positively charged area. A diode is composed of a section of N-type material bounded to a section of P-type material, with electrodes on one end. This arrangement conducts electricity in only one direction. When no voltage is applied to the diode, electrons from the N-type material fill holes from the P-type material along the junction between the layers, forming a depletion zone. In a depletion zone, the semiconductor material is returned to its original insulating state (all of the holes are filled, so there are no free electrons or empty spaces for electrons, and charge can't flow).

To get rid of the depletion zone, the electrons must get moving from the N-type area to the P-type area. In order to accomplish this, the N-type side of the diode is connected to the negative end of a circuit and the P-type side is connected to the positive end. The free electrons in the N-type material are repelled by the negative electrode and drawn to the positive electrode. The holes in the P-type material move the other way toward the negative electrode. When the voltage difference between the electrodes is high enough, the electrons in the depletion zone are boosted out of their holes and begin moving freely again. The depletion zone disappears and charge moves across the diode. The interaction between the electrons and holes generates light.

Light is a form of energy that can be released by an atom in packets known as photons. Photons are released as a result of electrons moving within the atom in orbitals around the nucleus. Electrons in different orbitals have different amounts of energy. For an electron to jump from a lower orbital to a higher orbital energy is often absorbed. However, an electron releases energy when it drops from a higher orbital to a lower orbital. The greater energy drop releases a higher energy photon which is typically characterized by higher frequency. Thus when free electrons move across a diode and fall into empty holes from the P-type layer they drop to a lower orbital and release energy in the form of photons.

Visible light emitting diodes, which are the type used in the present invention, are made up of materials that have a wider gap between their conduction band, or higher orbital, and the lower orbitals. Thus when the electrons fall to the lower orbitals over such a large distance, the energy released can be seen. The size of the gap determines the frequency of the photon and hence the color of the light. LEDs are specially constructed to release a large number of photons outward. Additionally they are housed in a plastic bulb that concentrates the light in a particular direction. Most of the light from the diode bounces off the sides of the bulb and travels out the end.

LEDs have several advantages over conventional incandescent lamps. For instance, LEDs don't have a filament that will burn out so they have a longer life. In addition, LEDs are efficient. In conventional incandescent bulbs, the light production process involves generating a lot of heat since the filament must be warmed. This is completely wasted energy, because the majority of the available electricity is not used to produce light. LEDs generate very little heat with a much greater percentage of the energy being used to generate light.

Although the preferred embodiment of the present invention utilizes LEDs, other lights that exist that would be considered an obvious substitute in the industry can be used.

SUMMARY OF THE INVENTION

It is an object of the present invention to provide a novel LED light apparatus and methodology.

Still another object of the present invention is to provide a novel LED light apparatus and methodology that can produce a collinear beam of white or colored light.

An additional object of the present invention is to provide a novel LED light apparatus and methodology that incorporates a base and a housing.

It is yet another object of the present invention to provide a novel LED light apparatus and methodology that incorporates upper, lower and side heat sinks to dissipate heat from the apparatus.

Another object of the present invention is to provide a novel LED light apparatus and methodology that incorporates a red, blue and green LED light assembly with LED lights arranged in an a×a, a×b or other suitable geometric pattern and located within the interior of the apparatus housing.

Yet another object of the present invention is to provide a novel LED light apparatus and methodology that incorporates a dichroic bandpass filter and dichroic notch filter arranged at a 45 degree angle to each other.

Still another object of the present invention is to provide a novel LED light apparatus and methodology that incorporates a power driver for providing power to the apparatus.

An additional object of the present invention is to provide a novel LED light apparatus and methodology that incorporates a microcontroller for controlling the apparatus.

Another object of the present invention is to provide a novel LED light apparatus and methodology that is an integrated web server being easily operated by any computer utilizing a standard industry browser.

In satisfaction of these and related objectives, Applicant's present invention

In satisfaction of these and related objectives, Applicant's present invention provides an LED light apparatus and methodology that can produce a collinear beam of white or colored light. The apparatus has a housing which incorporates three sets of LED light assemblies each set having a plurality of LED lights arranged in an a x a, a x b or other suitable geometric pattern. Each set contains LED lights of the same color, being either red, blue or green. A dichroic bandpass filter and a dichroic notch filter are also incorporated. The apparatus is attached to a power driver which connects to a microcontroller, being a DMX controller, TCP/IP controller, or the like. When the apparatus is turned on, red light from the red LED lights passes through the dichroic bandpass filter. The resulting light then combines with the blue light from the blue LED lights and passes through dichroic notch filter. This next light stream then combines with the green light from the green LED lights to form a collinear beam of white or colored light.

DETAILED DESCRIPTION OF THE PREFERRED EMBODIMENT

Figure 1:
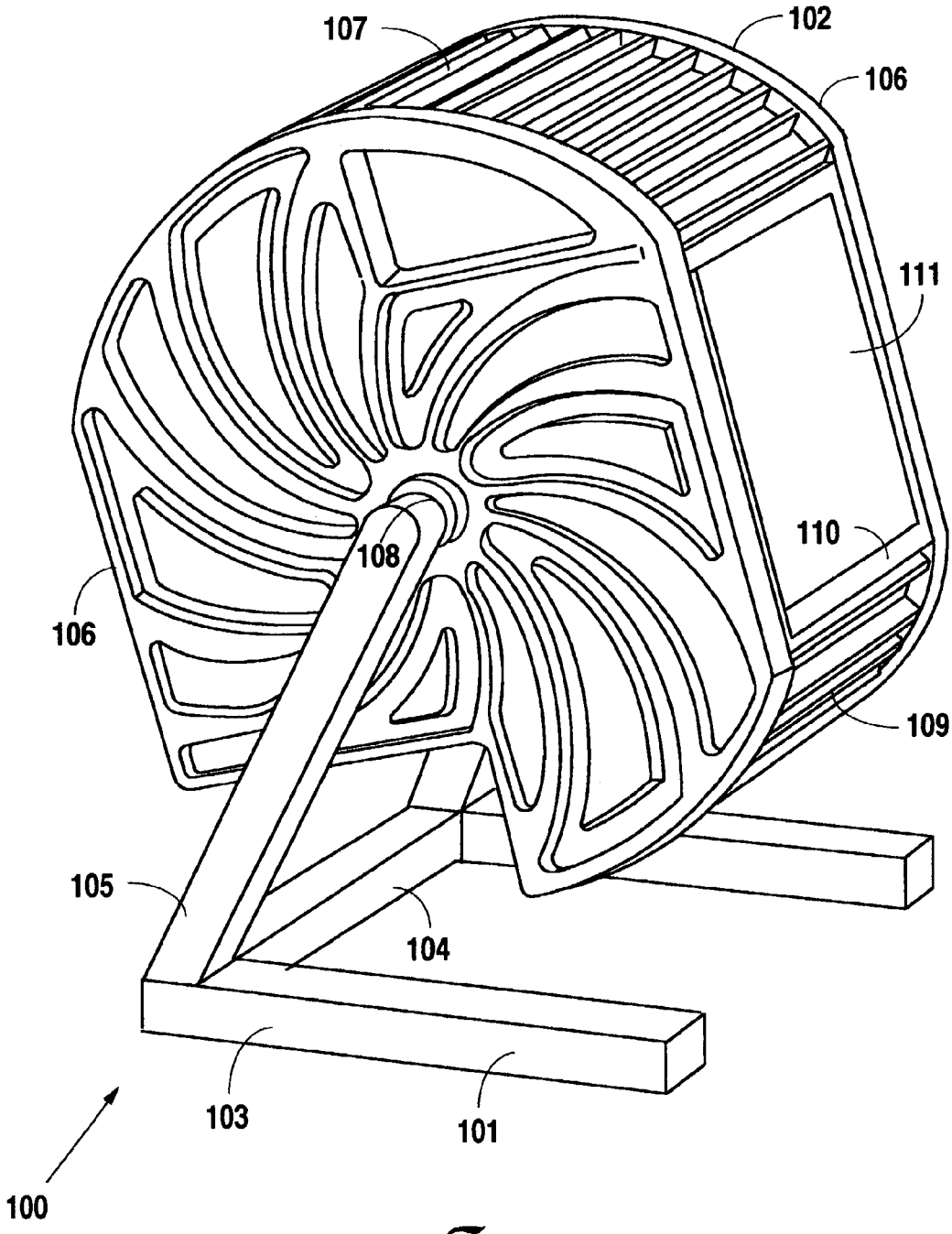
FIG. 1 is a perspective view of the preferred embodiment of the present invention.

FIG. 1 is a perspective view of the preferred embodiment of the present LED light apparatus 100. The apparatus 100 has a base 101 and a housing 102. Base 101 can be assembled in many obvious designs to functionally support housing 102. In instances where it is necessary to secure the present apparatus 100 to the wall or ceiling, an appropriate mounting structure (not shown) can be attached to the top or back of the present invention effectively eliminating the need for the base 101. In the preferred embodiment, base 101 has two horizontal legs 103, each connected at the side of one end to opposing ends of connecting leg 104. At the end of horizontal legs 103 that incorporate connecting leg 104, there is attached at the top of each of horizontal legs 103 an angled leg 105 that extends upward to connect to housing 102 at base connection opening 108. Housing 102 as shown has two side heat sinks 106. Side heat sinks 106 are joined at their top portions with upper heat sink 107. The lower most portion of side heat sinks 106 being joined with lower heat sink 109. Attached at the front of apparatus 100 is light emission frame 110 bounded on its upper portion by upper heat sink 107 and on its lower portion by lower heat sink 109. Light emission frame 110 covers light emission screen 111.

Figure 2:
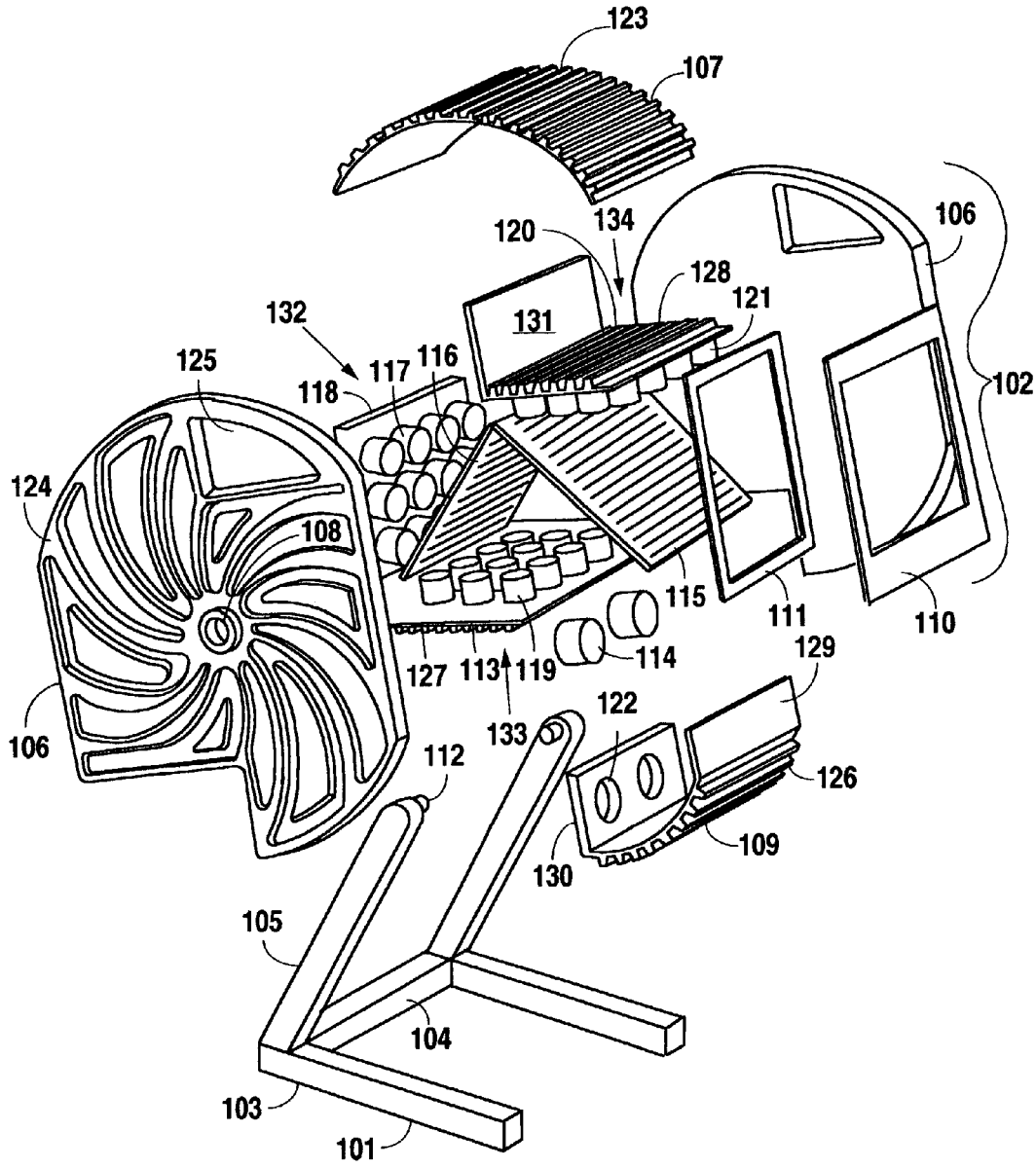
FIG. 2 is an exploded view of the preferred embodiment of the present invention.

In FIG. 2 an exploded view of the preferred embodiment of the present apparatus 100 is shown. Apparatus 100 has base 101 and housing 102. Base 101 has two horizontal legs 103, each connected at the side of one end to opposing ends of connecting leg 104. At the end of horizontal legs 103 that incorporate connecting leg 104, there is attached at the top of each of horizontal legs 103 an angled leg 105 that extends upward. A connection nib 112 at the opposite end of angled leg 105 is used for connecting angled leg 105 to housing 102 at base connection Housing 102 as shown has two side heat sinks 106. Side heat sinks 106 are preferably passive heat sinks designed with side heat sink fins 124 and opening 125 to dissipate heat through convection. Side heat sinks 106 are designed to be joined at their top portions with upper heat sink 107. Upper heat sink 107 is a passive heat sink having upper heat sink fins 123 and designed to dissipate heat generated primarily at the upper portion of apparatus 100. The lower most portion of side heat sinks 106 are designed to be joined with lower heat sink 109. Lower heat sink 109 is a passive heat sink designed to dissipate heat primarily generated at the lower portion of the apparatus 100 with lower heat sink fins 126. Lower heat sink 109 is contiguous at one end with a connecting facia 129 which is designed to underlap with the lower portion of light emission screen 111. Contiguous at the remaining end of lower heat sink 109 is first vertical facia 130 which is designed to be secured to apparatus 100 by way of posts 114 which can be positioned through post openings 122. Attached at the front of apparatus 100 is light emission frame 110 bounded on its upper portion by upper heat sink 107 and on its lower portion by lower heat sink 109. Light emission frame 110 covers light emission screen 111. Light emission screen 111 can consist of a single screen or multiple screens. Etches, ridges, or the like can be included on these screens so as to manipulate the shape of the resulting beam of light from apparatus 100.

Contained centrally within apparatus 100 are three sets of LED light assemblies, 132, 133, and 134. Each set 132, 133, and 134 has a plurality of LED lights 117, 119, and 121, respectively, arranged in an a×a or a×b pattern. Other suitable geometries may be used as well. These may include, but are not limited to, circles, elipses, trapezoids, parallelograms, triangles, honeycombs, and the like. Each set contains LED lights of the same color, being either red 117, blue 119 or green 121. Red LED light assembly 132 contains red LED lights 117 on its interior surface and heat sink 118 on its exterior surface. Blue LED light assembly 133 has blue LED lights 119 on its interior surface and heat sink 113 on its exterior surface. Fins 127 of heat sink 113 help dissipate heat. Green LED light assembly 134 contains green LED lights 121 on its interior surface and heat sink 120 on its exterior surface. Heat sink 120 is contiguous at one end with second vertical facia 131 used to connect heat sink 120 within apparatus 100. A dichroic bandpass filter 116 and a dichroic notch filter 115 are also incorporated within apparatus 100.

Figure 3:
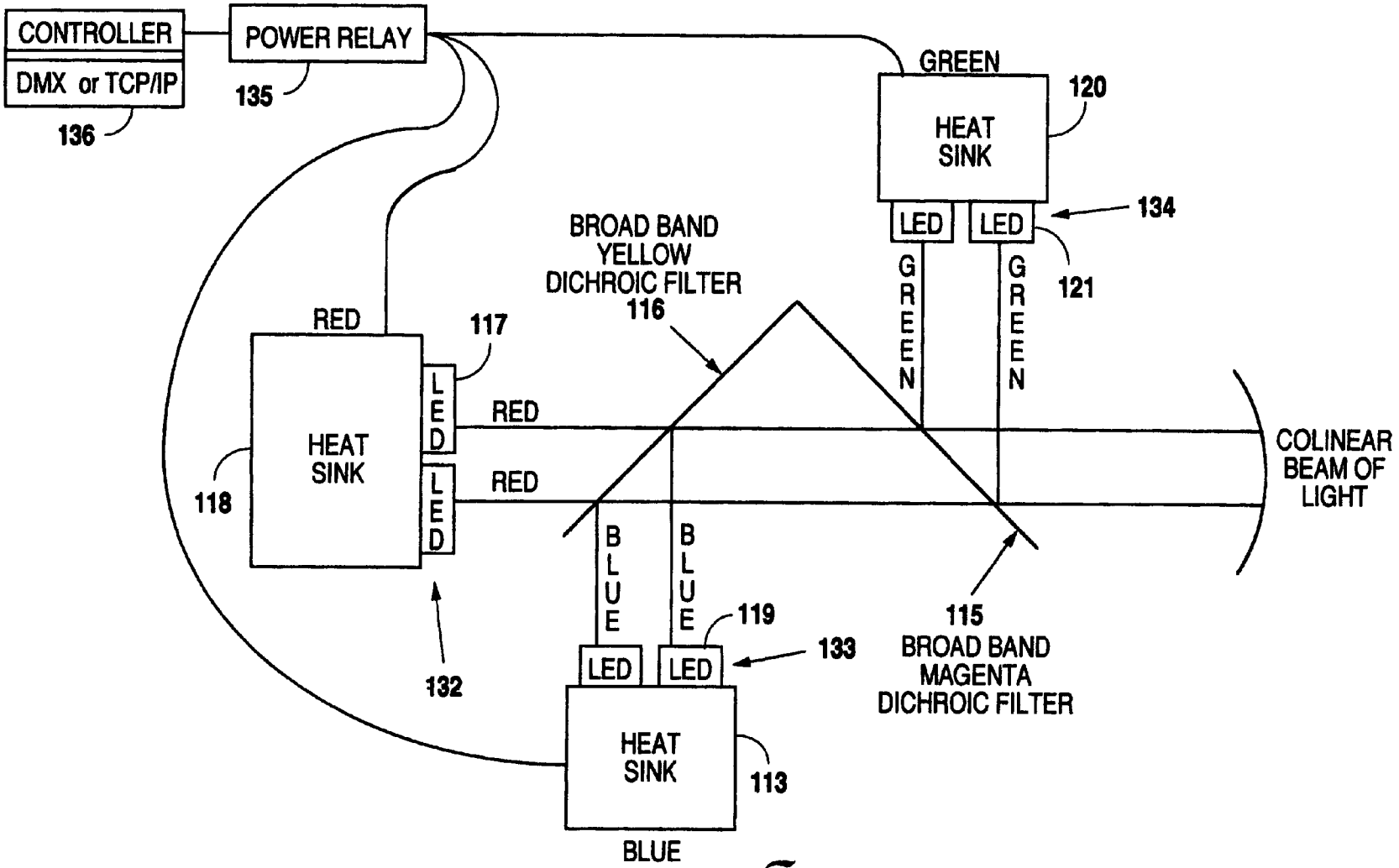
FIG. 3 is a schematic of the internal operation of the preferred embodiment of the present invention.

FIG. 3 is a schematic of the internal operation of the preferred embodiment of the present invention. Red LED light assembly 132 contains red LED lights 117 on its interior surface and heat sink 118 on its exterior surface. Heat sink 118 is preferably passive, but can be active as well. Where heat sink 118 is a passive heat sink it has no mechanical components and dissipates heat through convection. Active heat sinks on the other hand utilize power and are usually cooling fans, thermoelectric heat pumps (also known as Peltier junctions), or other similar cooling device.

Blue LED light assembly 133 has blue LED lights 119 on its interior surface and heat sink 113 on its exterior surface. Green LED light assembly 134 contains green LED lights 121 on its interior surface and heat sink 120 on its exterior surface. Heat sinks 113 and 120 can be active or passive heat sinks as well.

A dichroic bandpass filter 116 and a dichroic notch filter 115 are also incorporated within apparatus 100. The apparatus is attached to a power driver 135 which connects to a microcontroller 136, being a Digital Music Express (DMX) controller, Transmission Control Protocol Internet Protocol (TCP/IP) controller, Musical Instrument Digital Interface (MIDI) controller, User-Defined Interrupt-Procedures (UDIP) controller or the like. When the apparatus 100 is turned on an additive color mixing process occurs. Red light from the red LED lights 117 passes through the dichroic bandpass filter 116. The resulting light then combines with the blue light emanating from the blue LED lights 119 and passes through dichroic notch filter 115. This combined light stream then combines with the green light from the green LED lights 121 to form a collinear beam of white or colored light.

Figure 4:
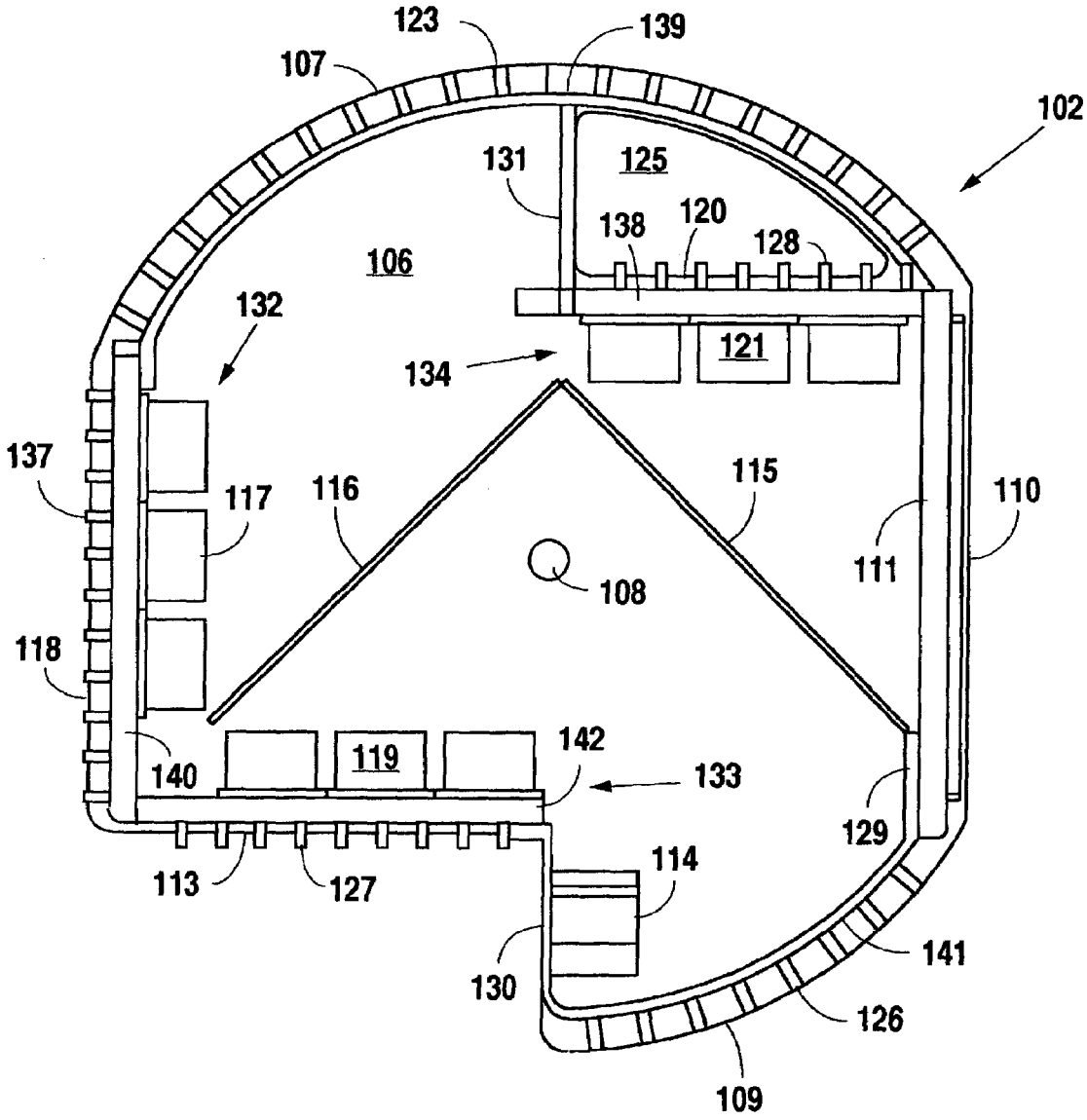
FIG. 4 is a cut away side view of the preferred embodiment of the present invention.

In FIG. 4 a cut away side view of the preferred embodiment of housing 102 of the present apparatus 100 is shown. As shown there is one side heat sink 106. As mentioned, side heat sink is preferably a passive heat sink designed with an opening 125 to allow dissipation of heat through convection. Base connection opening 108 is present to allow connection to base 101 (See FIG. 1). Side heat sink 106 is joined at its top portion with upper heat sink 107.

Upper heat sink 107 is preferably a passive heat sink as well having upper heat sink fins 123. Upper heat sink 107 is connected to upper heat sink support 139 Upper heat sink support 139 extends to the rear of housing 102 and connects to red LED light support 140. Red LED light support 140 has red LED light heat sink 118 connected at its exterior and red LED light assembly 132 attached at the interior. Red LED light assembly 132 has red LED lights 117. Toward the front of housing 102, upper heat sink support 139 extends and connects with one end of green LED light heat sink 120. Extending approximately medially below upper heat sink 107 is one end of second vertical facia 131. The opposing end of second vertical facia 131 is contiguous with green LED light heat sink 120 which has fins 128 for the dissipation of heat from the green LED light assembly 134. Fins 128 are connected to the exterior side of green LED light assembly support 138. The interior side of green LED light assembly support 138 is connected to green LED light assembly 134 which contains green LED lights 121.

The lowermost portion of side heat sink 106 is joined with lower heat sink 109. Lower heat sink 109 dissipates heat primarily generated at the lower portion of apparatus 100 with lower heat sink fins 126. Lower heat sink 109 has lower heat sink support 141 which is contiguous at one end with connecting facia 129. Connecting facia 129 underlaps light emission screen 111. Contiguous at the remaining end of lower heat sink support 141 is first vertical facia 130 which is secured to housing 102 by way of posts 114. Attached at the front of apparatus 100 is light emission frame 110 bounded on its upper portion by upper heat sink 107 and on its lower portion by lower heat sink 109. Light emission frame 110 covers light emission screen 111.

Connected at the topmost portion of first vertical facia 130 is one end of blue LED light heat sink 113 designed to dissipate heat from the blue LED light assembly 133 and having fins 127. Blue LED light heat sink 113 is supported by blue LED light support 142. On the interior of blue LED light support 142 is blue LED light assembly 133 which has blue LED lights 119.

At the opposing end of blue LED light heat sink 113 is one end of red LED light heat sink 118 which has fins 137 designed to dissipate heat through convection from red LED light assembly 132. Blue LED light support 142 connects with red LED light support 140. Located centrally within housing 102 is dichroic bandpass filter 116 and dichroic notch filter 115.

Figure 5:
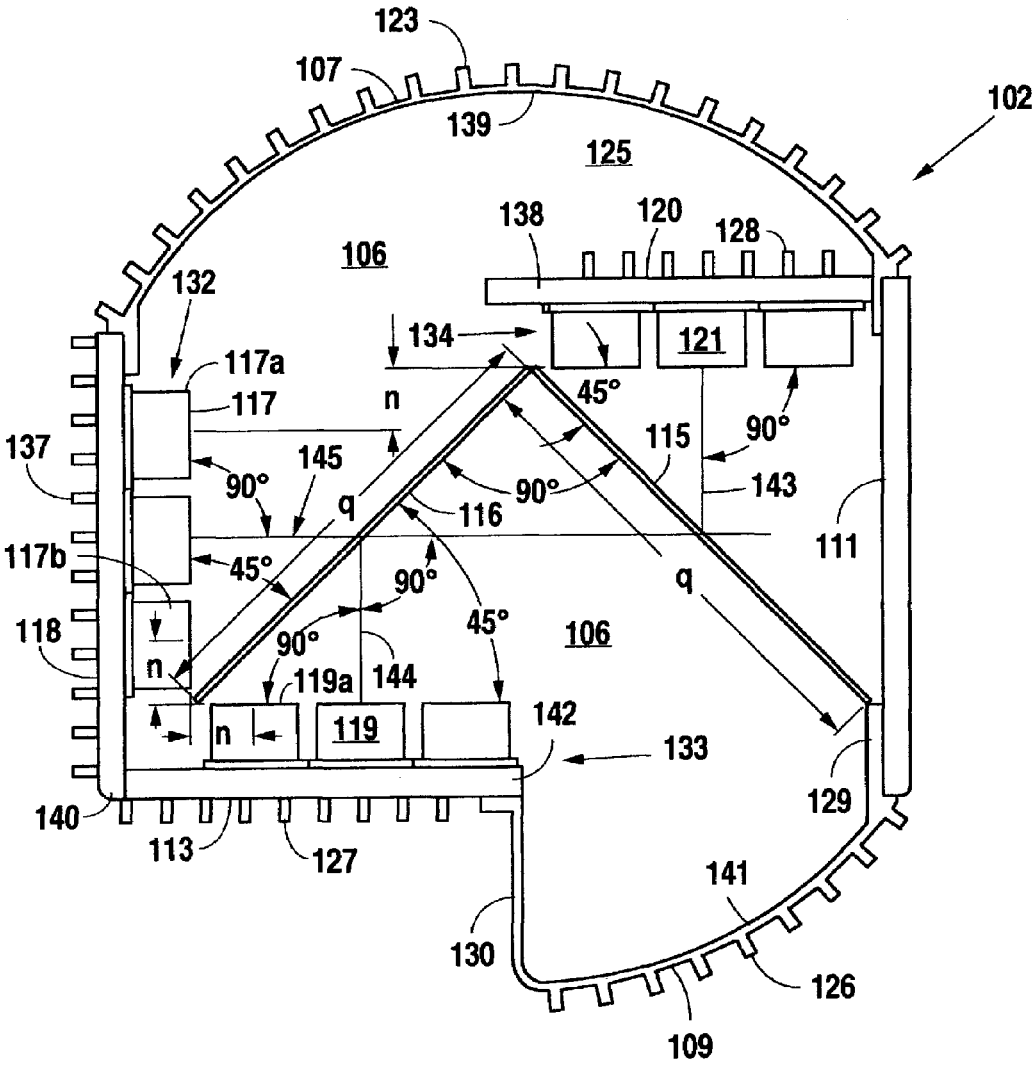
FIG. 5 is a detailed cut away view of the preferred embodiment of the present invention.

FIG. 5 is a detailed cut away view of the preferred embodiment of the housing 102 of the present apparatus 100. As shown there is one side heat sink 106 joined at its top portion with upper heat sink 107.

Upper heat sink 107 is connected to upper heat sink support 139. Upper heat sink support 139 extends to the rear of housing 102 and connects to red LED light support 140. Red LED light support 140 has red LED light heat sink 118 connected at its exterior and red LED light assembly 132 attached at its interior. Red LED light assembly 132 has red LED lights 117. Toward the front of housing 102, upper heat sink support 139 extends and connects with one end of green LED light heat sink 120. Green LED light heat sink 120 has fins 128 for the dissipation of heat from the green LED light assembly 134. Fins 128 are connected to the exterior side of green LED light assembly support 138. The interior side of green LED light assembly support 138 is connected to green LED light assembly 134 which contains green LED lights 121. The front of green LED lights 121 is placed at an angle 45° from dichroic notch filter 115. The angle of the green LED light ray 143 with respect to the green LED lights 121 is 90°, green LED light ray 143 striking dichroic notch filter 115 at a 45° angle. A line drawn normal to the center of the last red LED light 117*a* of red LED light assembly 132 is placed a distance n from the front of green LED lights 121.

The lowermost portion of side heat sink 106 is joined with lower heat sink 109. Lower heat sink 109 dissipates heat primarily generated at the lower portion of apparatus 100 with lower heat sink fins 126. Lower heat sink 109 has lower heat sink support 141 which is contiguous at one end with connecting facia 129. Connecting facia 129 underlaps light emission screen 111. Contiguous at the remaining end of lower heat sink support 141 is first vertical facia 130. Connected at the topmost portion of first vertical facia 130 is one end of blue LED light heat sink 113 designed to dissipate heat from the blue LED light assembly 133 and having fins 127. Blue LED light heat sink 127 is supported by blue LED light support 142. On the interior of blue LED light support 142 is blue LED light assembly 133 which has blue LED lights 119. The front of blue LED lights 119 is placed at an angle 45° from dichroic bandpass filter 116. The angle of blue LED light ray 144 with respect to the blue LED lights 119 is 90°, blue LED light ray 144 striking dichroic bandpass filter 116 at a 45° angle with respect to a line normal to the surface of dichroic bandpass filter 116. A line drawn normal to the center of the first blue LED light 119*a* of blue LED light assembly 133 is placed a distance n from the front of red LED lights 117.

At the opposing end of blue LED light heat sink 113 is one end of red LED light heat sink 118 which has fins 137 designed to dissipate heat through convection from red LED light assembly 132. A line drawn normal to the center of the first red LED light 117*b* of red LED light assembly 132 is placed a distance n from the front of blue LED lights 119. The front of red LED lights 117 is placed at an angle 45° from dichroic bandpass filter 116. The angle of the red LED light ray 145 with respect to the red LED lights 117 is 90°, red LED light ray 145 striking dichroic bandpass filter 116 at an angle of 45° with respect to a line normal to the surface of dichroic bandpass filter 116. Blue LED light support 142 connects with red LED light support 140. Located centrally within housing 102 is dichroic bandpass filter 116 and dichroic notch filter 115 being of the same length, one end of dichroic bandpass filter 116 being connected at a right angle with one end of dichroic notch filter 115.

When the apparatus 100 is turned on, red LED light rays 145 from the red LED lights 117 strike the backside of dichroic bandpass filter 116 at a 45° angle with respect to a line drawn normal to the surface of dichroic bandpass filter 116. Red LED light rays 145 pass through the dichroic bandpass filter 116. The resulting stream of red light then combines with the blue LED light rays 144 emanating from the blue LED lights 119. The blue LED light rays 144 strike the dichroic bandpass filter 116 at an angle 45° with respect to a normal drawn to the surface of the dichroic bandpass filter 116. In this case, the reflected blue light will be reflected at a 90° angle with respect to the incident blue LED light ray 144.

When the resulting stream of red light combines with the blue reflected light, the combined light passes through dichroic notch filter 115. The stream of light that passes through dichroic notch filter 115 then combines with green LED light rays 143 emanating from green LED lights 121. The green LED light rays 143 strike the dichroic notch filter 115 at an angle 45° with respect to a normal drawn to the surface of the dichroic notch filter 115. In this case, the reflected green light will be reflected at a 90° angle with respect to the incident green LED light ray 143. When the resulting light from dichroic notch filter 115 combines with the green light from green LED lights 121, a collinear beam of white or colored light is formed.

Figure 6:
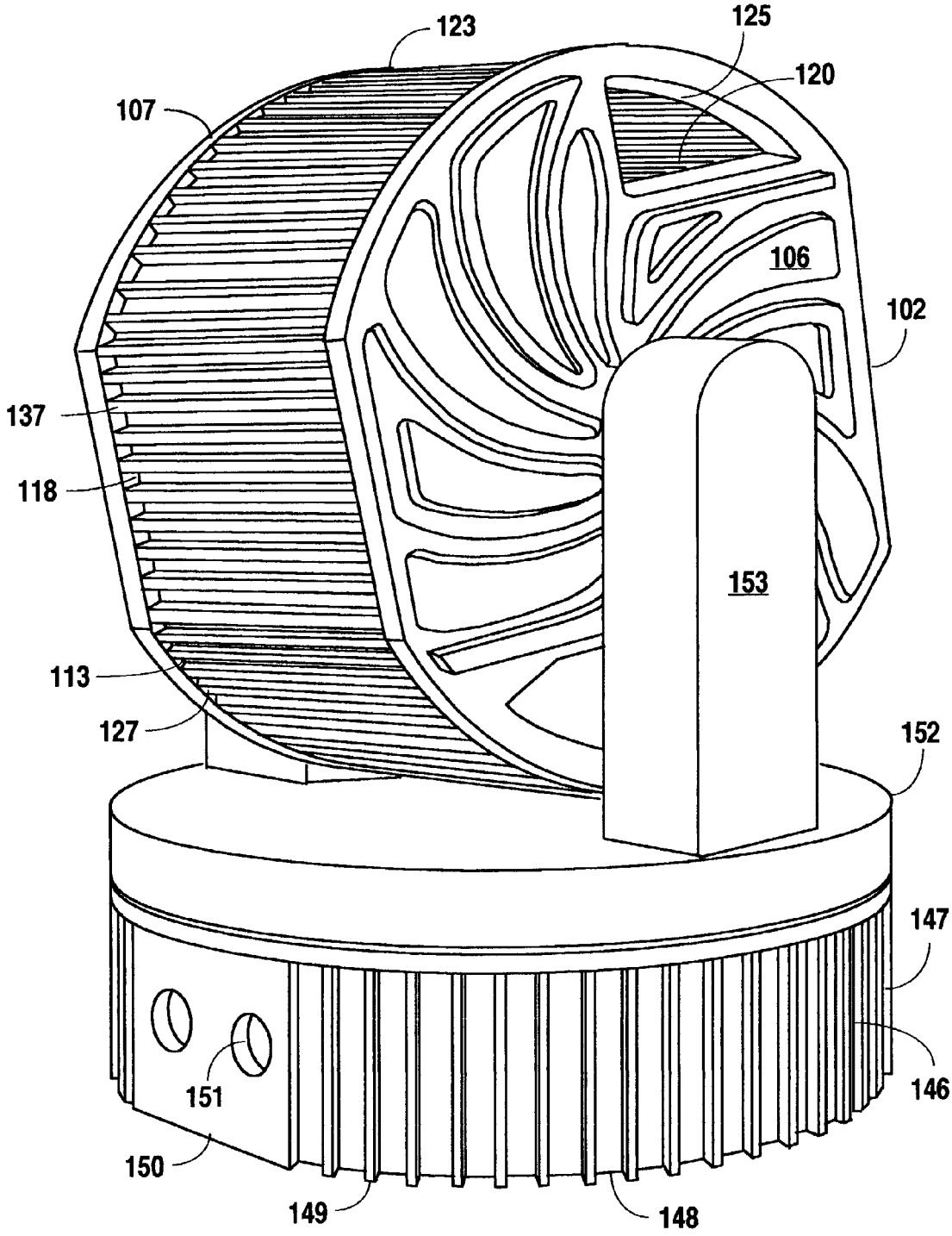
FIG. 6 is a back perspective view of the second embodiment of the present invention.

In FIG. 6 a back perspective view of the second embodiment of the present apparatus 100 is shown. The apparatus 100 of the second embodiment is essentially the same as the preferred embodiment except base 101 has been modified to yoke 146. Apparatus 100 has a yoke 146 and a housing 102. Yoke 146 is designed to robotically control movement of apparatus 100. Yoke 146 at its lower portion has electronic assembly 147 which incorporates heat sink 148, having fins 149, connected to a connection fitting 150 that includes a port 151 for connection to an external power supply (See FIG. 3). Lower portion of yoke 146 houses the necessary electronics for operation of yoke 146 in controlling the movement of apparatus 100. Any standard robot control assembly can be incorporated herein. At the upper portion of yoke 146 is base 152 which is contiguous with two vertical legs 153 which extend upward from each side of base 152 and connect at their opposing ends to housing 102 at base connection opening 108.

Housing 102 has two side heat sinks 106. Side heat sinks 106 are joined at their top portions with upper heat sink 107 having fins 123. Located at the rear of housing 102 and connected to upper heat sink 107 is red LED light heat sink 118 having fins 137. Connected below red LED light heat sink 118 is blue LED light heat sink 113 with fins 127. Shown partially through opening 125 of side heat sink 106 is green LED light heat sink 120.

Figure 7:
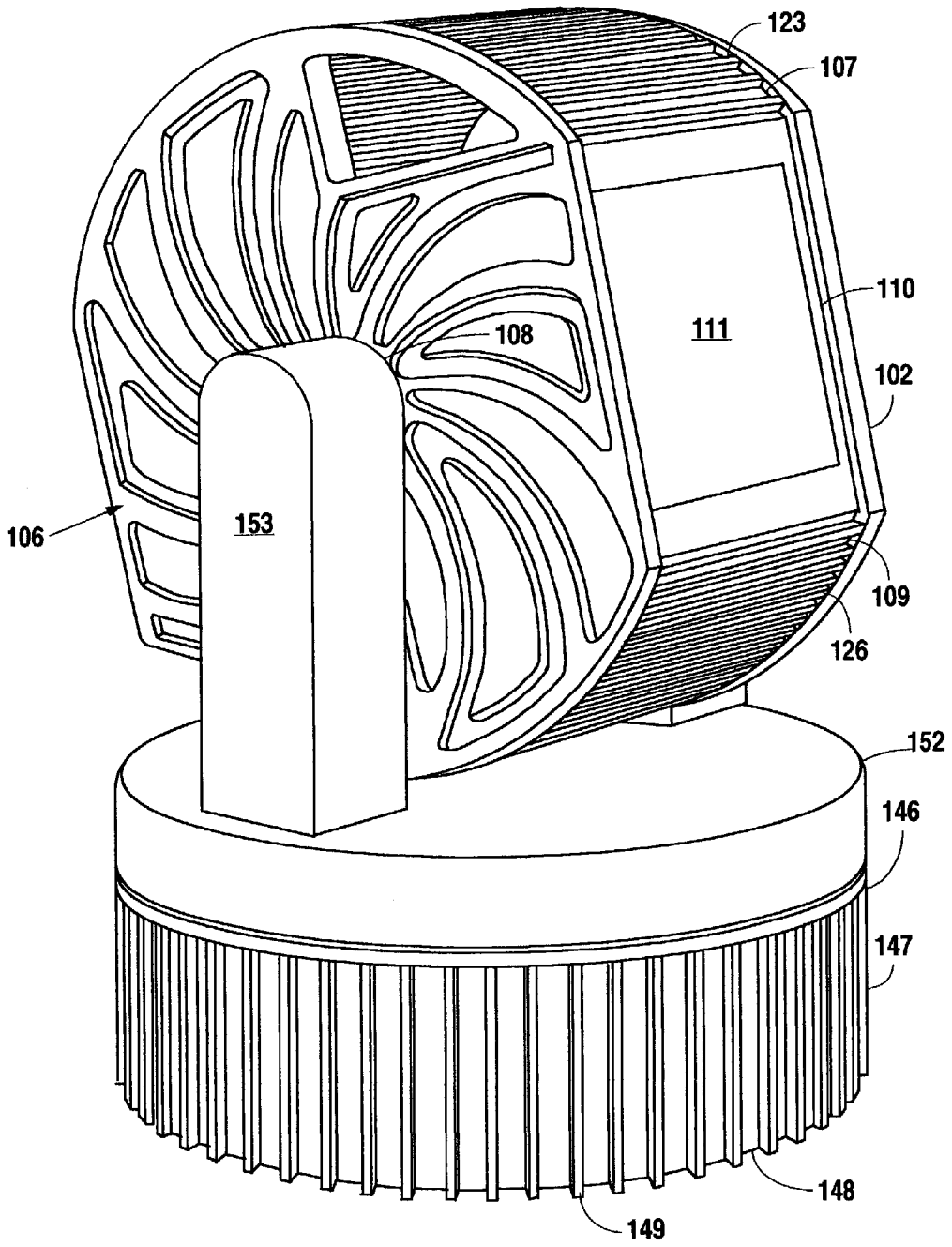
FIG. 7 is a front perspective view of the second embodiment of the present invention.

FIG. 7 is a front perspective view of the second embodiment of the present apparatus 100. The apparatus 100 has a yoke 146 and a housing 102. Yoke 146 is designed to robotically control movement of apparatus 100. Yoke 146 at its lower portion has electronic assembly 147 which incorporates heat sink 148. Lower portion of yoke 146 houses the necessary electronics for operation of yoke 146 in controlling the movement of apparatus 100. At the upper portion of yoke 146 is base 152 which is contiguous with two vertical legs 153 which extend upward from each side of base 152 and connect at their opposing ends to housing 102 at base connection opening 108.

Housing 102 has two side heat sinks 106. Side heat sinks 106 are joined at their top portions with upper heat sink 107 having fins 123. The lower most portion of side heat sinks 106 being joined with lower heat sink 109 having fins 126. Attached at the front of apparatus 100 is light emission frame 110 bounded on its upper portion by upper heat sink 107 and on its lower portion by lower heat sink 109. Light emission frame 110 covers light emission screen 111.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An LED light apparatus for producing a collinear beam of white or colored light comprising:

a housing;

at least three sets of LED light assemblies contained within said housing, wherein each of said sets of LED light assemblies is comprised of a plurality of LED lights, said LED lights being arranged in a geometric pattern, and wherein said LED lights contained within each of said sets of LED light assemblies are of the same color, said LED lights being of different colors between said sets of LED light assemblies;

a dichroic bandpass filter located between said sets of LED light assemblies;

a dichroic notch filter located between said sets of LED light assemblies intersecting said dichroic bandpass filter;

a power driver connected to each of said sets of LED light assemblies;

a microcontroller connected to said power driver;

wherein said at least three sets of LED light assemblies contain LED lights of blue, red, and green forming blue LED light assembly, red LED light assembly, and green LED light assembly.

2. The LED light apparatus for producing a collinear beam of white or colored light of claim 1 wherein the perimeter of said housing comprises a plurality of heat sinks to dissipate heat from said LED light apparatus.

3. The LED light apparatus for producing a collinear beam of white or colored light of claim 1 wherein said housing incorporates a light emission screen for emitting the produced collinear beam of white or colored light.

4. The LED light apparatus for producing a collinear beam of white or colored light of claim 1 wherein said blue LED light assembly is arranged at right angles to said red LED light assembly.

5. The LED light apparatus for producing a collinear beam of white or colored light of claim 1 wherein said green LED light assembly is arranged at right angles to said red LED light assembly.

6. The LED light apparatus for producing a collinear beam of white or colored light of claim 1 wherein said dichroic bandpass filter is at a 90 degree angle with said dichroic notch filter.

7. The LED light apparatus for producing a collinear beam of white or colored light of claim 1 wherein said red LED light assembly is at a 45 degree angle with said dichroic bandpass filter.

8. The LED light apparatus for producing a collinear beam of white or colored light of claim 1 wherein said blue LED light assembly is at a 45 degree angle with said dichroic bandpass filter.

9. The LED light apparatus for producing a collinear beam of white or colored light of claim 1 wherein said green LED light assembly is at a 45 degree angle with said dichroic notch filter.

10. A method of producing a collinear beam of white or colored light comprising the steps of:

emitting a first set of light rays from a first LED light assembly said first LED light assembly contains LED lights of red forming a red LED light assembly striking said first set of light rays against a first side of a dichroic bandpass filter;

passing said first set of light rays through said dichroic bandpass filter;

emitting a second set of light rays from a second LED light assembly;

reflecting said second set of light rays against a second side of said dichroic bandpass filter;

combining said first set of light rays with said second set of light rays to form a combined light stream;

passing said combined light stream through a first side of a dichroic notch filter;

emitting a third set of light rays from a third LED light assembly;

reflecting said third set of light rays against a second side of said dichroic notch filter; and combining said third set of light rays with said combined light stream to form a collinear beam of white or colored light wherein said collinear beam of white or colored light passes through a light emission screen.

11. The method of producing a collinear beam of white or colored light of claim 10 wherein said second LED light assembly contains LED lights of blue forming a blue LED light assembly.

12. The method of producing a collinear beam of white or colored light of claim 11 wherein said blue LED light assembly is arranged at right angles to said red LED light assembly.

13. The method of producing a collinear beam of white or colored light of claim 10 wherein said third LED light assembly contains LED lights of green forming a green LED light assembly.

14. The method of producing a collinear beam of white or colored light of claim 13 wherein said green LED light assembly is arranged at right angles to said red LED light assembly.

15. The method of producing a collinear beam of white or colored light of claim 13 wherein said green LED light assembly is at a 45 degree angle with said dichroic notch filter.

16. A method of producing a collinear beam of white or colored light comprising the steps of:

emitting red light rays from a red LED light assembly;

striking said red light rays against a first side of a dichroic bandpass filter;

passing said red light rays through said dichroic bandpass filter;

emitting blue light rays from a blue LED light assembly;

reflecting said blue light rays against a second side of said dichroic bandpass filter;

combining said red light rays with said blue light rays to form a combined light stream;

passing said combined light stream through a first side of a dichroic notch filter;

emitting green light rays from a green LED light assembly;

reflecting said green light rays against a second side of said dichroic notch filter; and combining said green light rays with said combined light stream to form a collinear beam of white or colored light.

* * * * *